US005644190A

United States Patent [19]

Potter

[11] Patent Number: 5,644,190

[45] Date of Patent: Jul. 1, 1997

[54] DIRECT ELECTRON INJECTION FIELD-EMISSION DISPLAY DEVICE

[75] Inventor: Michael D. Potter, Grand Isle, Vt.

[73] Assignee: Advanced Vision Technologies, Inc., Rochester, N.Y.

[21] Appl. No.: 498,505

[22] Filed: Jul. 5, 1995

[51] Int. Cl.[6] ..... H01J 19/24

[52] U.S. Cl. ..... 313/336; 313/309; 313/351

[58] Field of Search ..... 313/308, 309, 313/336, 351, 495

[56] References Cited

U.S. PATENT DOCUMENTS

| | | | |
|---|---|---|---|
| 3,789,471 | 2/1974 | Spindt et al. | 29/25.17 |
| 4,721,885 | 1/1988 | Brodie | 313/576 |
| 4,728,851 | 3/1988 | Lambe | 313/309 |
| 4,827,177 | 5/1989 | Lee et al. | 313/306 |
| 5,127,990 | 7/1992 | Pribat et al. | 156/644 |
| 5,141,459 | 8/1992 | Zimmerman | 445/24 |
| 5,144,191 | 9/1992 | Jones et al. | 313/308 |
| 5,203,731 | 4/1993 | Zimmerman | 445/24 |
| 5,214,347 | 5/1993 | Gray | 313/355 |
| 5,233,263 | 8/1993 | Cronin et al. | 313/309 |
| 5,266,155 | 11/1993 | Gray | 156/651 |
| 5,278,475 | 1/1994 | Jaskie et al. | 315/169.3 |
| 5,281,890 | 1/1994 | Kane | 313/309 |
| 5,289,086 | 2/1994 | Kane | 315/349 |
| 5,290,610 | 3/1994 | Kane et al. | 427/577 |
| 5,308,439 | 5/1994 | Cronin et al. | 156/656 |
| 5,341,063 | 8/1994 | Kumar | 313/309 |
| 5,382,185 | 1/1995 | Gray et al. | 445/49 |
| 5,386,172 | 1/1995 | Komatsu | 313/309 |
| 5,397,957 | 3/1995 | Zimmerman | 313/309 |

OTHER PUBLICATIONS

Katherine Derbyshire, "Beyond AMLCDs: Field emission displays?" Solid State Technology vol. 37 No. 11 (Nov. 1994) pp. 55–65.

*Primary Examiner*—Sandra L. O'Shea
*Assistant Examiner*—Vip Patel
*Attorney, Agent, or Firm*—Theodore R. Touw

[57] ABSTRACT

A lateral-emitter electron field-emission display device structure incorporates a thin-film emitter having an emitting edge in direct contact with and extending into a non-conducting or very high resistivity phosphor, thereby eliminating the gap between the emitter and the phosphor. Such a gap has been a part of all field-emission display devices in the prior art. The ultra-thin-film lateral emitter of the new structure is deposited in a plane parallel to the device's substrate and has an inherently small radius of curvature at its emitting edge. A fabrication process specially adapted to make the new structure includes a directional trench etch, which both defines the emitting edge and provides an opening to receive a non-conducting phosphor. This phosphor covers an anode and is automatically aligned in contact with the emitter edge. When an electrical bias voltage is applied between the emitter and anode, electrons are injected directly into the phosphor material from the emitter edge, exciting cathodoluminescence in the phosphor to emit light which is visible in a wide range of viewing angles. With minor variations in the fabrication process, a lateral-emitter electron field emission display device may be made with an extremely small emitter-phosphor gap, having a width less than 100 times the thickness of the ultra-thin emitter. Embodiments in which the gap width is zero are characterized as edge-contact light-emitting diodes (or triodes or tetrodes if they include control electrodes).

16 Claims, 5 Drawing Sheets

| |
|---|
| FIG. 4a |
| FIG. 4b |

DIRECT ELECTRON INJECTION FIELD-EMISSION DISPLAY DEVICE

This application is related to copending application Ser. No. 08/498,507 by Michael D. Potter titled "Fabrication Process for Direct Electron Injection Field-Emission Display Device," filed in the United States Patent and Trademark Office on Jul. 5, 1995. The invention of this application is described in Disclosure Document No. 374966, received by the United States Patent and Trademark Office on Apr. 25, 1995.

FIELD OF THE INVENTION

This invention relates generally to flat-panel displays, and more particularly to displays of the type using cold-cathode field-emmission electron sources, which may be arranged in a matrix array.

BACKGROUND OF THE INVENTION

Field-emission displays are considered an attractive alternative and replacement for liquid-crystal displays, because of their lower manufacturing cost and lower complexity, lower power consumption, higher brightness, and improved range of viewing angles. A review article on the general subject of vacuum microelectronics was published in 1992: Heinz H. Busta "Vacuum Microelectronics—1992," Journal of Micromechanics and Microengineering, Vol. 2, No. 2, June 1992. An article by Katherine Derbyshire, "Beyond AMLCDs: Field Emission Displays?" Solid State Technology, Vol. 37, No. 11, Nov. 1994, pages 55–65, summarized fabrication methods and principles of operation of some of the competing designs for field-emission devices and discussed some applications of field-emission devices to flat-panel displays. The theory of cold field emission of electrons is discussed in many textbooks and monographs, including the monograph by Robert Gomer, "Field Emission and Field Ionization" (Cambridge, Mass., Harvard University Press, 1961), Chapter 1, pages 1–31, and the monograph by R. O. Jenkins and W. G. Trodden, "Electron and Ion Emission From Solids" (New York, N.Y., Dover Publications, Inc., 1965), Chapter 4, pages 35–43.

NOTATIONS AND NOMENCLATURE

Phosphor is used in this specification to mean a material characterized by cathodoluminescence. In descriptions of phosphors, a conventional notation is used wherein the chemical formula for a host or matrix compound is given first, followed by a colon and the formula for an activator and/or co-activators (an impurity that activates the host crystal to luminesce), as in ZnS:Mn, where zinc sulfide is the host and manganese is the activator. Ohmic contact is used herein to denote an electrical contact that is non-rectifying. The terms emitter and cathode are used interchangeably throughout this specification to mean a field-emission cathode. The term "control electrode" is used herein to denote an electrode that is analogous in function to the control grid in a vacuum-tube triode. Such electrodes have also been called "gates" in the field-emission device related art literature. The term "non-conductive" is used to refer to a material whose conduction band is substantially empty of electrons at temperatures at or below room temperature (20° C.).

DESCRIPTION OF THE RELATED ART

Microelectronic devices using field emission of electrons from cold-cathode emitters have been developed for various purposes to exploit their many advantages including high-speed switching, insensitivity to temperature variations and radiation, low power consumption, etc. Most of the microelectronic field-emission devices in the related art have included emitters which point orthogonally to the substrate, generally away from the substrate, but sometimes toward the substrate. Examples of this type of device are shown, for example, in U.S. Pat. No. 3,789,471 to Spindt et al., U.S. Pat. No. 4,721,885 to Brodie, U.S. Pat. No. 5,127,990 to Pribat et al., U.S. Pat. Nos. 5,141,459 and 5,203,731 to Zimmerman, U.S. Pat. No. 5,278,475 to Jaskie et at., U.S. Pat. No. 5,283,501 to Zhu et at., U.S. Pat. No. 5,290,610 to Kane et al., U.S. Pat. No. 5,341,063 to Kumar, and in the above-mentioned article by Derbyshire. In such structures, the anode is typically a transparent faceplate parallel to the substrate, and the faceplate carries a phosphor which produces the display's light output by cathodoluminescence. A few cold-cathode microelectronic devices have included field emitters oriented in a plane substantially parallel to their substrates, as for example in U.S. Pat. No. 4,728,851 to Lambe, U.S. Pat. No. 4,827,177 to Lee et al., U.S. Pat. No. 5,289,086 to Kane, and U.S. Pat. Nos. 5,233,263 and 5,308,439 to Cronin et al. The terminology "lateral field emission" and "lateral cathode" of the latter two patents to Cronin et al. will be adopted herein to refer to a structure in which the field emitter edge or tip points in a lateral direction, i.e. substantially parallel to the substrate. Some device structures and fabrication processes using lateral cathode configurations have been found to have distinct advantages, such as extremely fine cathode edges or tips and precise control of the inter-element dimensions, alignments, capacitances, and required bias voltages.

While vacuum fluorescent displays (VFD's) may also use similar phosphors, they typically have thermionic cathodes operating in vacuum, and they use high accelerating voltages (often more than 100 Volts) to impart high kinetic energy to the electrons impinging on their phosphor-coated anodes. Electroluminescent displays are typically fabricated with insulators on both sides of a phosphor layer, so that the number of electrons available is finite, and limited to the number of electrons created in electron-hole pair creation or in interface detrapping processes. Prior art lateral electron field-emission display devices have a gap extending across a major portion of the distance between the emitter and a phosphor-coated anode.

PROBLEMS SOLVED BY THE INVENTION

While it is desirable to operate displays at low bias voltages, field-emission displays that include a gap between the emitter and the anode phosphor require bias voltages that increase with the size of the gap. A problem that has frequently occurred in use of field-emission display devices having a gap between emitter and phosphor is unwanted change in electron emission due to atmospheric contamination of the emitter tip, causing work-function changes with consequent changes in emission current over time with the same applied voltage. While this problem has often been solved by providing a vacuum or low-pressure inert atmosphere surrounding the emitter tip, such measures have increased the cost and complexity of the devices and their fabrication processes. A problem that has been inherent in the fabrication processes for field-emission display devices including a gap is the necessity of ensuring that the gap is clean and free of contaminants. In practical fabrication processes this has required careful cleaning of the gap regions before enclosing the gap region in a vacuum or controlled atmosphere.

OBJECTS AND ADVANTAGES OF THE INVENTION

One object of the invention is a field-emission display device that has no gap between its field-emission cathode tip and its phosphor. Stated in another way, an object of the invention is an edge-contact light-emitting diode. A related object is a display device operable with reduced operating voltage. Another object is reduced device-to-device variability within a display array. Another object is a display device that has its field emitter tip inherently passivated and protected from adverse atmospheric effects. A related object is a display device that does not require a coating of passivation. Another related object is a device which does not require operation in a vacuum or controlled gas atmosphere to protect the emitter tip from undesirable ambient atmosphere effects. Another object of the invention is a field-emission display device utilizing non-conducting or very high resistivity phosphors that are readily available. Another object of the invention is a field-emission display device that can be fabricated in a fabrication process that does not require cleaning of an inter-electrode gap region. Another object is a field-emission device structure which has a thin-film emitter automatically aligned in direct contact with a phosphor, by a fabrication process that utilizes conventional semiconductor fabrication apparatus and processing techniques. An overall object of the invention is an improved microelectronic device which nevertheless retains all the known advantages of lateral-emitter field-emission devices, including the following: extremely fine cathode edges or tips; exact control of the cathode-to-control-electrode distance (to control the control-electrode-to-cathode overlap, and thereby control the inter-electrode capacitances and more precisely control the required bias voltage); inherent alignment of the control-electrode and cathode structures; self-alignment of the anode structure to the control-electrode and cathode; and improved layout density. Another object of the invention in retaining known advantages of lateral-emitter field-emission devices is the significant design flexibility provided by an integrated structure which reduces the number of interconnections between devices, thus reducing costs and increasing device reliability and performance. Another important object of the invention is a process using existing microelectronic fabrication techniques and apparatus for making integrated lateral-emitter direct electron-injection field-emission display devices with economical yield and with precise control and reproducibility of device dimensions and alignments. Other objects include edge-contact light-emitting triodes, tetrodes, . . . , etc. having one or more control electrodes. Related objects include light-emitting multi-electrode display devices whose output can be modulated by application of electrical signals. These and other objects and advantages will be apparent from the following description of the invention and various embodiments thereof.

SUMMARY OF THE INVENTION

A lateral-emitter electron field-emission display device structure disclosed herein incorporates a thin film emitter having an emitting edge in direct contact with a non-conducting or very high resistivity phosphor, thereby eliminating the gap that prior art field-emission display devices have had between the emitter and the phosphor. The ultra-thin-film lateral emitter of the new structure is deposited in a plane parallel to the device's substrate and has an inherently small radius of curvature at its emitting edge. A fabrication process specially adapted to make the new structure includes a directional trench etch, which both defines the emitting edge and provides an opening to receive a non-conducting phosphor. This phosphor covers at least part of an anode and is automatically aligned in contact with the emitter edge. When an electrical bias voltage is applied between the emitter and anode, electrons are injected directly into the phosphor material from the emitter edge, exciting cathodoluminescence in the phosphor to emit light visible in a wide range of viewing angles. The device may be made with one or more control electrodes, which are also automatically aligned with the emitter edge, whereby the output of the device may be modulated by application of suitable electrical signals. With minor variations in the fabrication process, a lateral-emitter electron field-emission display, device may be made with extremely small emitter-phosphor gap, having a width up to about 100 times the ultra-thin emitter's thickness. Embodiments in which the gap width is zero are characterized as edge-contact light-emitting diodes (or triodes, or tetrodes, etc. if they include control electrodes).

FIGS. *4a* and *4b* together show schematically a flow diagram illustrating a preferred embodiment of a fabrication process performed in accordance with the invention.

FIGS. *5a–5r* together show a sequence of cross sectional views of a device at various stages of the fabrication process depicted in FIGS. *4a* and *4b*.

DETAILED DESCRIPTION OF THE PREFERRED EMBODIMENTS

Figure 1:
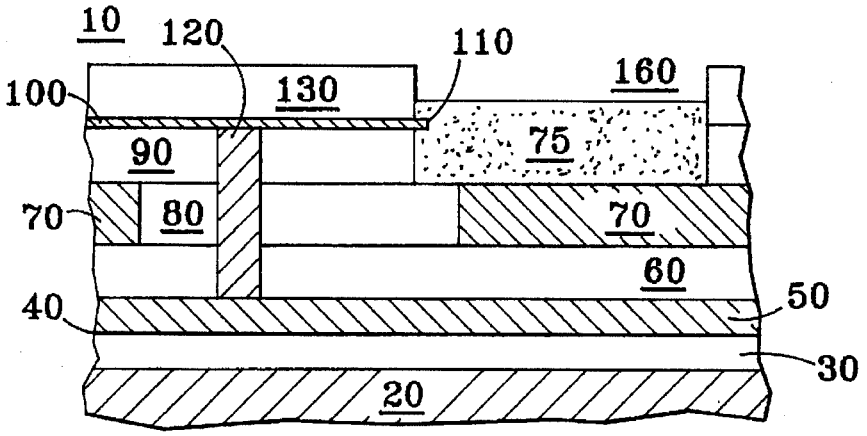
FIG. 1 shows a side elevation view in cross-section of a preferred embodiment of a field-emission display device made in accordance with the invention.

The basic structure of devices made in accordance with the invention may be clearly understood by considering the single device of FIG. 1. It should be noted that the drawing figures are not drawn to scale. In particular, the vertical scale in the cross-section elevation drawings is greatly exaggerated for clarity of the structural features.

Figure 2:
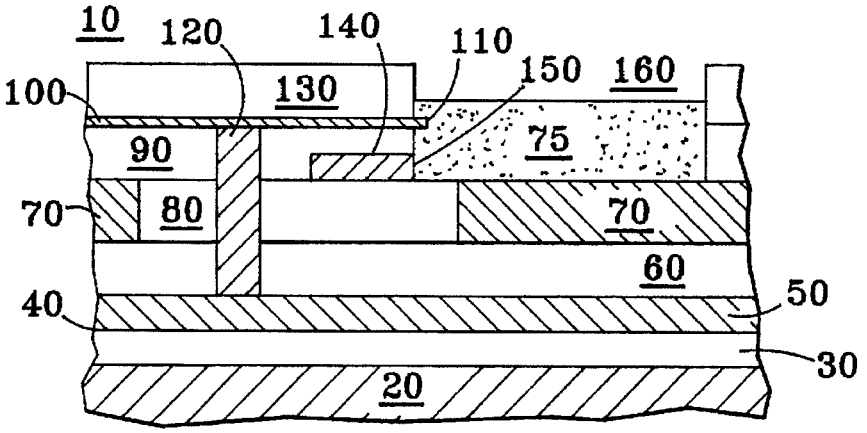
FIG. 2 shows a side elevation view in cross-section of a field-emission display device structure having a control electrode.

FIG. 1 shows a side elevation cross-sectional view of an embodiment of a single field-emission device made in accordance with the invention, The field-emission device, denoted generally by 10, is made on a flat substrate 20. A layer of insulator 30 has a top major surface, which defines a reference plane 40 convenient for description of other elements. A layer of conductive material 50 may be used as a buried contact layer. It should be noted that conductive layer 50 may lie on the reference plane, as shown in FIG. 1, or may be made by depositing conductive layer 50 into recesses formed in insulator 30 and by planarizing the resulting surface. In the latter case the top surface of conductive layer 50 lies in reference plane 40. A layer of insulator 60 is made on the reference plane 40, covering conductive layer 50. A conductive layer parallel to plane 40 serves as an anode 70. As will become apparent from a reading of the remainder of this specification and the appended claims, the preferred fabrication process described herein below automatically places the top surface of anode 70 below the plane of lateral emitter 100. For embodiments such as that of FIG. 1, in which some devices have independent anodes, the anodes of adjacent devices are separated and insulated from each other by regions of an insulator 80. At the left side of FIG. 1, a small portion of the anode 70 of an adjacent device is shown to the left of insulator 80; that portion is not involved in the structure or operation of the single device of the present description. An insulating layer 90 of predetermined thickness is made parallel to the substrate. An ultra-thin conductive layer which forms an emitter layer 100 is also made parallel to the substrate and patterned, thus forming a lateral emitter. A conductive contact 120 may connect emitter layer 100 to buried contact layer 50. (If the device is to have a control electrode 140 above emitter 100, then two additional layers are made: a layer of insulator 130 and a conductive layer patterned to form a control electrode 140. This arrangement is not shown in FIG. 1. An alternative arrangement for a control electrode 140 is shown in FIG. 2, described below.)

In the fabrication process for this device (described more fully herein below), an opening 160 is provided by employing a directional etch. That opening extends through all the layers of conductors and/or insulators lying above the anode down to the top surface of anode 70. The process of etching opening 160 forms a blade edge or tip 110 where lateral-emitter thin film 100 terminates after the etch. The blade edge or tip 110 has a very small radius of curvature, limited by half the thickness of the ultra-thin lateral-emitter layer 100. Preferred thicknesses of lateral-emitter film 100 are less than about 300 ångstroms, which limit the radius of curvature of lateral-emitter blade edge or tip to less than about 150 ångstroms. Those skilled in the art will recognize that the radius of curvature is a significant factor in producing an electric field at edge or tip 110 sufficient to cause cold-cathode field emission at a low applied bias voltage, and that the radius of curvature may be somewhat less than half of the film thickness. Another factor significant in determining the electric field effective in causing field emission is the (predetermined) thickness of insulator film 90. The degree of film thickness control in conventional semiconductor integrated processing is sufficient to control the thickness of insulator film 90 to the desired precision. Devices made in accordance with the present invention may be operated at applied bias voltages of 10 to 50 volts or even less.

Opening 160, extending from the device top surface to anode 70, provides space for a phosphor 75 disposed within the opening, on anode 70, and in direct contact with emitter edge or tip 110. To cover emitter edge or tip 110, the phosphor 75 must fill opening 160 to at least a level lying above emitter 100 as shown in FIG. 1. However, phosphor 75 may fill opening 160 to a higher level, for example to the device top surface. Selection of suitable phosphor materials is described herein below.

The directional etch which forms opening 160, or an optional isotropic etch performed at about the same time in the fabrication process, may preferentially etch insulators 90 and 130 slightly with respect to emitter layer 100, allowing emitter layer 100 to protrude slightly into opening 160 at emitter edge or tip 110.

It should be noted that ohmic conductive connections to the various electrodes of the device may be made in a conventional manner, and therefore these connections are not necessarily shown in the drawings. These conductive connections may be made, for example, by vertical studs that lie outside the plane of the side elevation cross-section view of FIG. 1. For example, a conductive stud may extend from emitter 100 and/or buried contact layer 50 to a surface conductive pad to which the emitter bias voltage may be applied. A similar conductive connection, electrically isolated from the emitter connection, may be made to anode 70, for application of the anode bias voltage. Similarly, conductive connections are needed to apply control signals to control electrode(s) 140 if the device is a triode or tetrode, etc. having such control electrodes. The arrangement just described may also be reversed, in the sense that the emitter connection may be made directly to a surface pad and the anode connection may be made to buried contact layer 50. Of course, for field emission of electrons to occur, the polarity of applied bias voltages must be such that the anode is positive with respect to the emitter. Various devices made on the same substrate need not have identical physical arrangements of conductive connections. Some devices may have buried anode contacts, while other devices on the same substrate may have buried emitter contacts. Such arrangements can allow compact and efficient circuit layout. With such arrangements, dissimilar connections lying in the same plane and not intended to be connected may be kept electrically independent by being spaced apart laterally and/or by having intervening insulator material disposed between them, as is known in the art.

The lateral-emitter field-emission device of FIG. 1 is a diode device, without a control electrode. FIG. 2 shows a side elevation cross-sectional view of an alternate embodiment of a single field-emission device made in accordance with the invention, and having a control electrode 140. Control electrode 140 may extend out of the plane of the cross-section of FIG. 2 to connect to conductive contacts. In operation of a display device with a control electrode, these conductive contacts are connected to an electrical signal by means of which the flow of electrons may be controlled, as in a triode device.

The field-emission device may be made with a plurality of anodes 70 (not shown in the drawings). A useful example of such a structure has three anodes per emitter, with a different color phosphor 75 on each anode. The color of emitted light is controlled by switching electrical bias voltage among the anodes. A particularly useful combination is a three-anode device with red, green, and blue phosphors for an RGB display. Similarly, the device may be made with a single anode 70 (which may have a plurality of different color phosphors 75 on it) and a plurality of emitters 100. In this configuration, the color of emitted light is controlled by switching electrical bias among the various emitters 100 associated with an anode 70.

Operable and preferred materials for the various structural elements of the lateral-emitter direct electron injection field-emission display device are described herein below in connection with the description of a novel and preferred fabrication process specially adapted for fabrication of this device.

A novel fabrication process using process steps similar to those used in semiconductor integrated circuit fabrication may be used to produce the devices and their arrays in accordance with the invention. Various embodiments of the fabrication process allow the use of conductive or insulating substrates and allow fabrication of devices having various functions and complexity. A notable feature of all the fabrication process embodiments described herein is that the phosphor is simply formed and disposed on an anode without the use of a spacer employed in some prior art processes. (In those prior art processes, a spacer was formed by a sacrificial conformal coating to define the width of a cathode-to-anode gap.)

Figure 3:
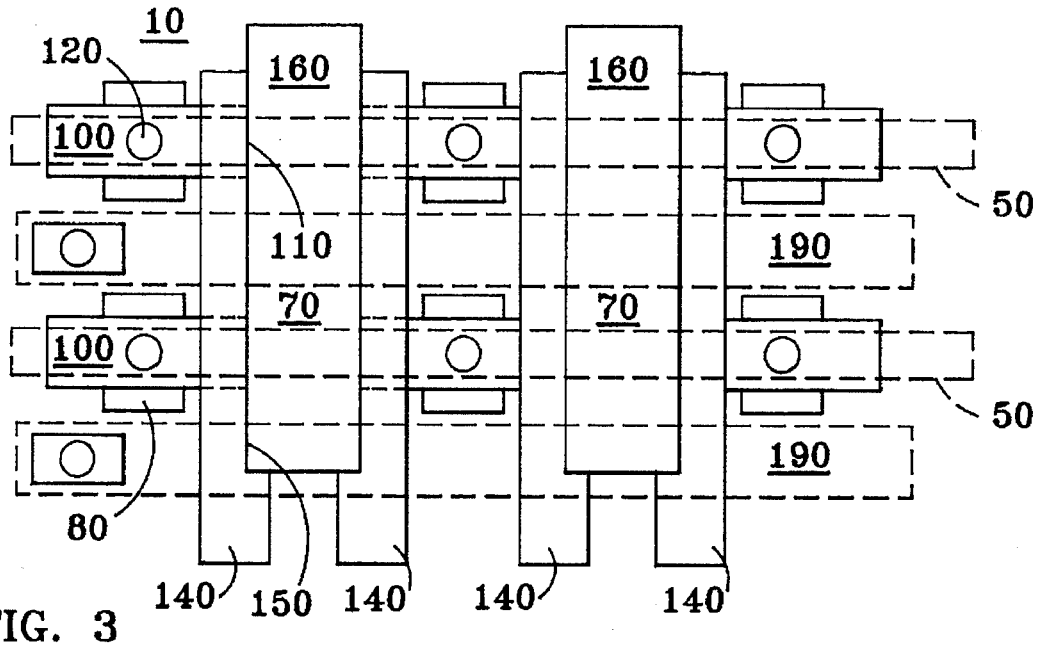
FIG. 3 shows a plan view of an array of field-emission display devices made in the preferred embodiment structure of FIG. 2.
Figure 4A:
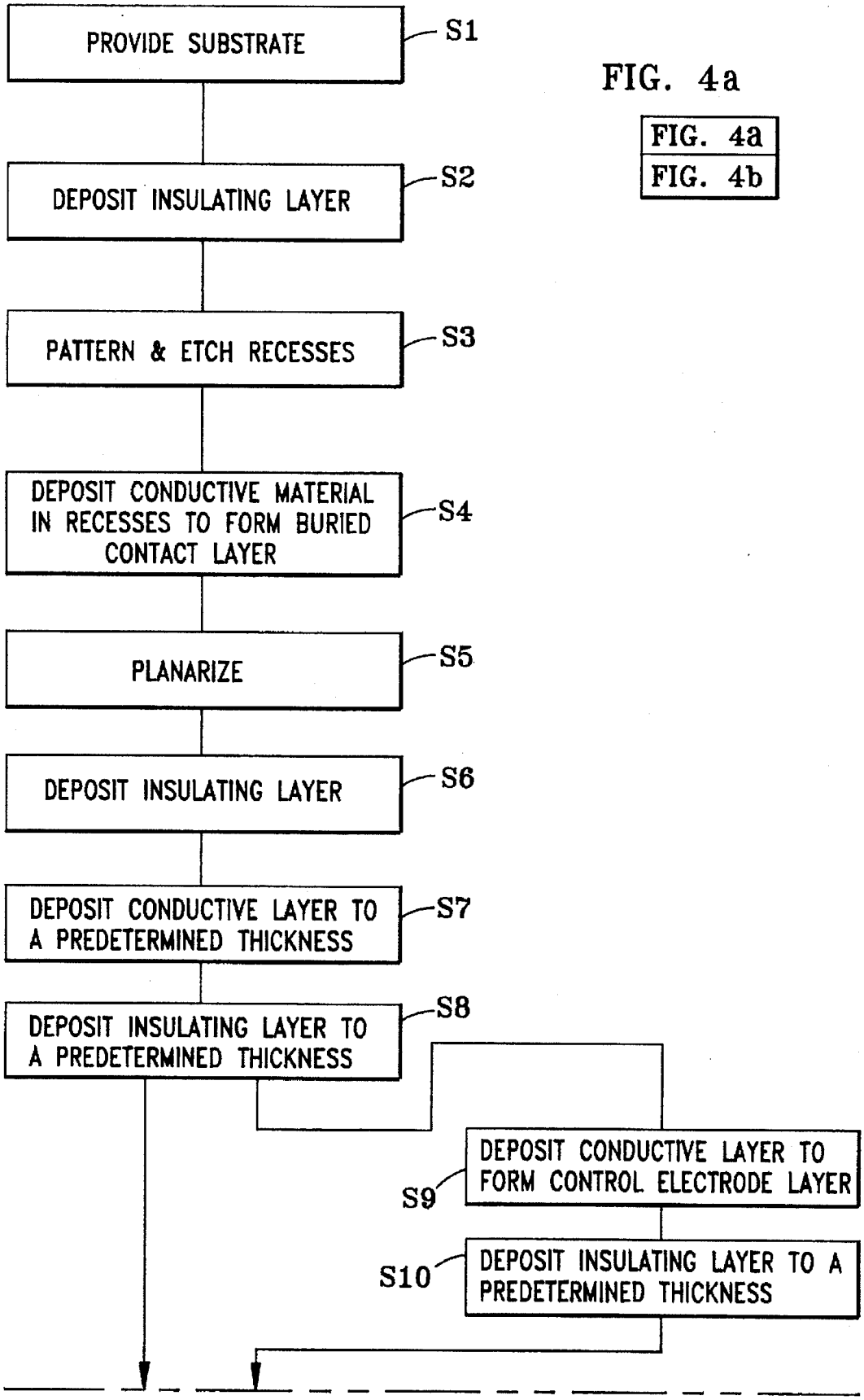
Figure 4B:
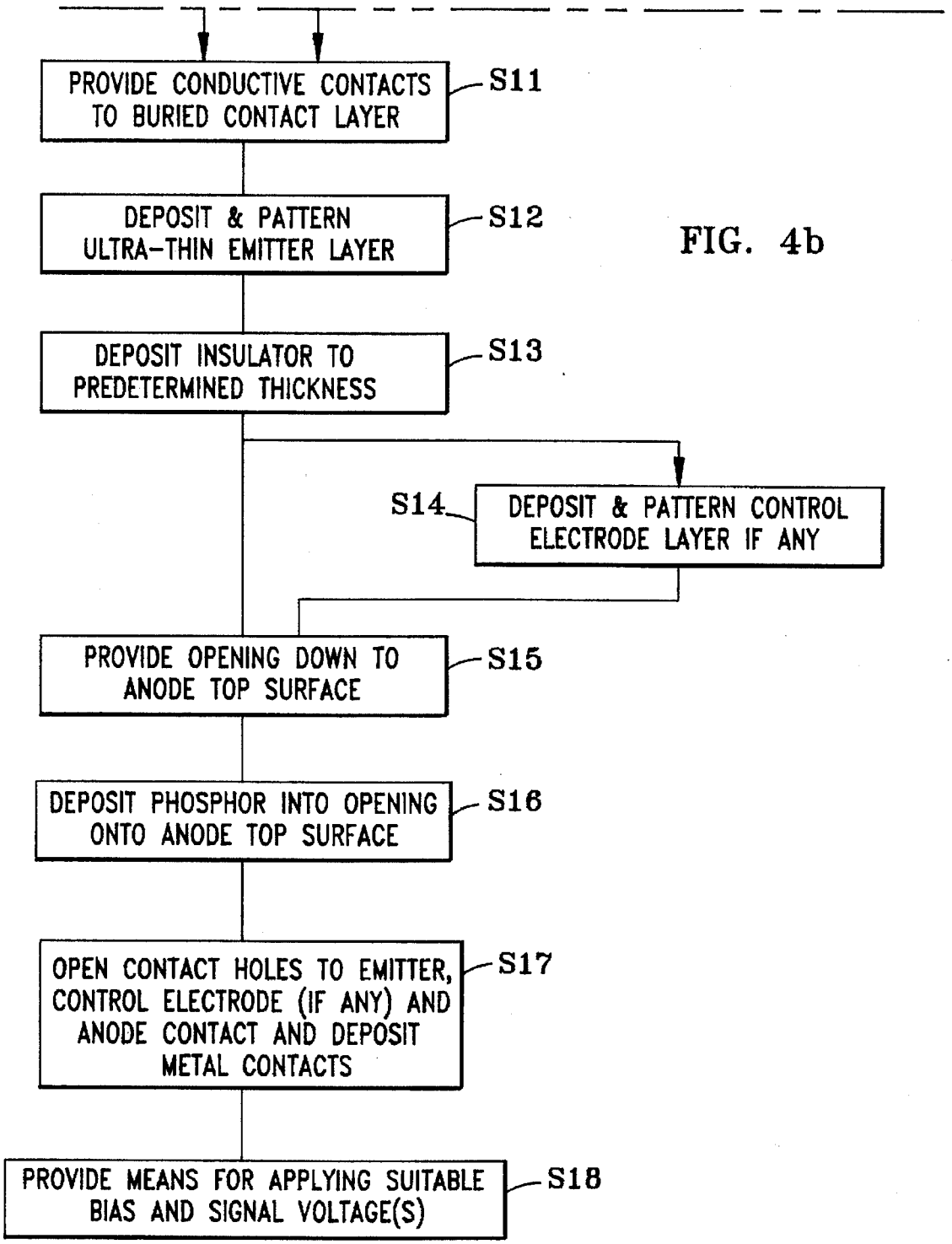
Figure 5A:
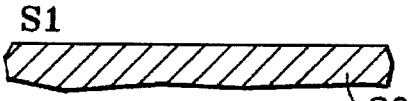
Figure 5B:
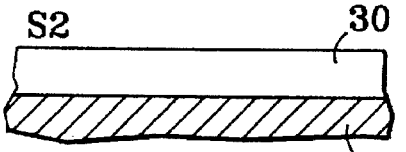
Figure 5C:
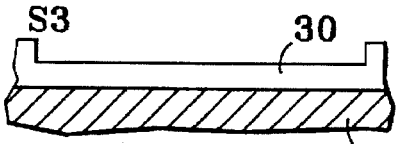
Figure 5D:
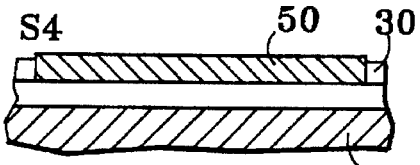
Figure 5E:
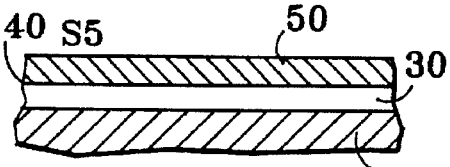
Figure 5F:
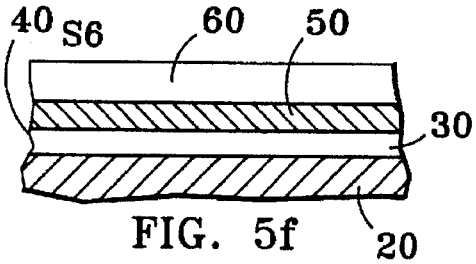
Figure 5G:
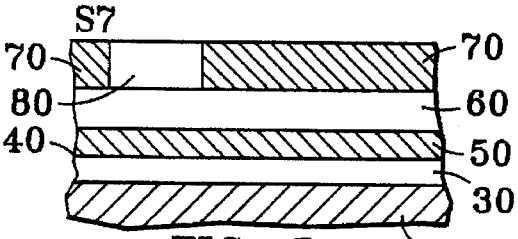
Figure 5H:
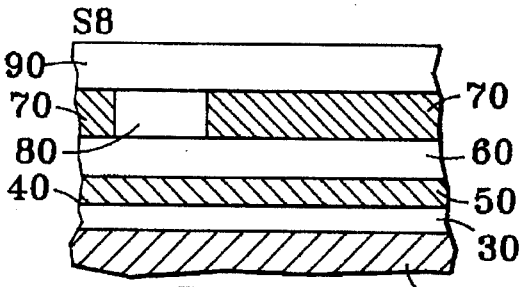
Figure 5I:
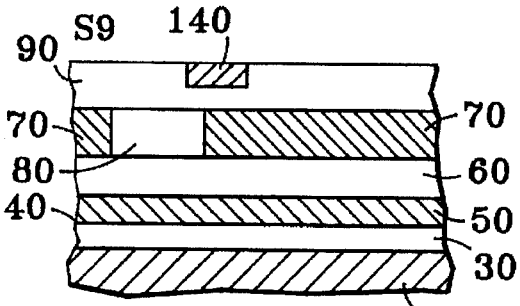
Figure 5J:
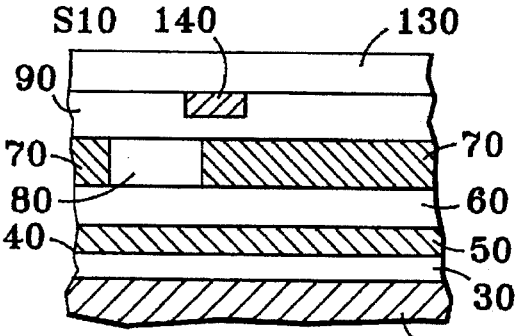
Figure 5K:
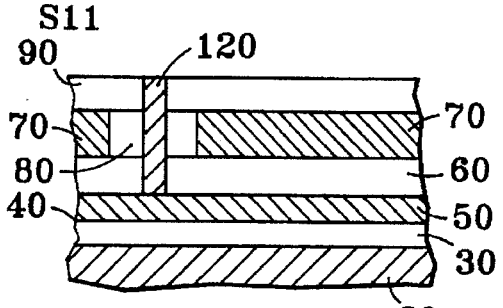
Figure 5L:
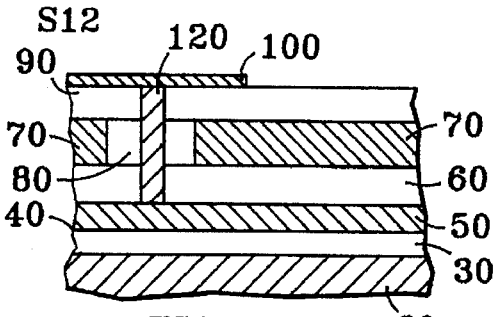
Figure 5M:
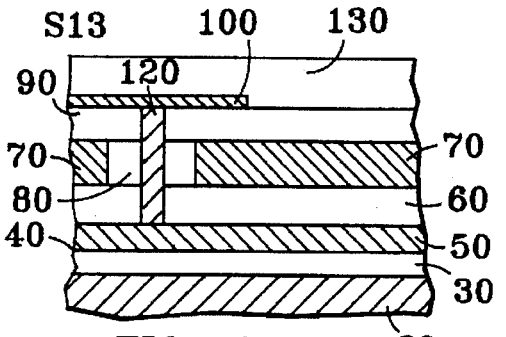
Figure 5N:
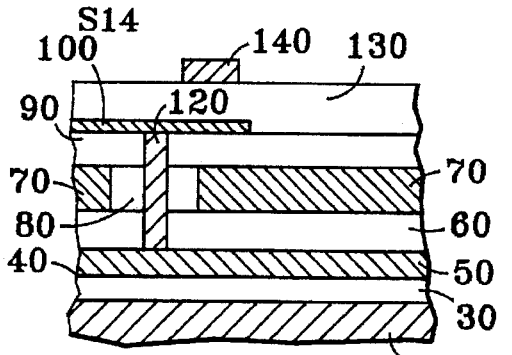
Figure 5O:
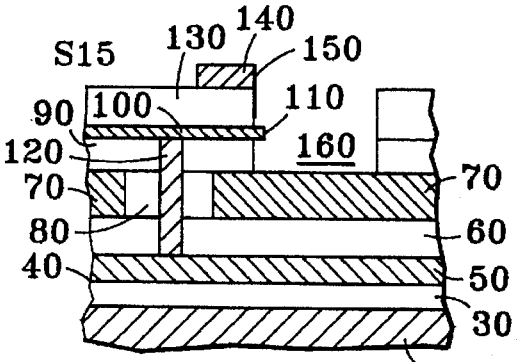
Figure 5P:
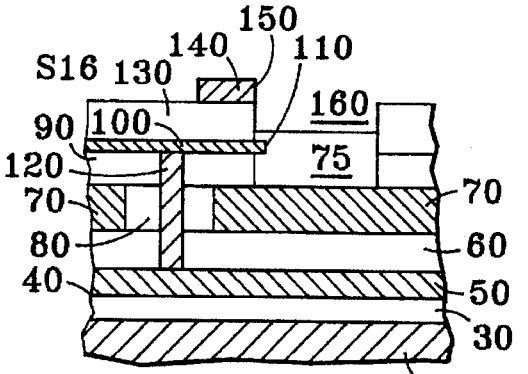
Figure 5Q:
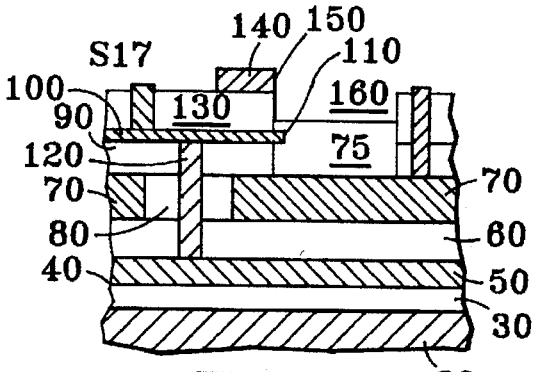
Figure 5R:
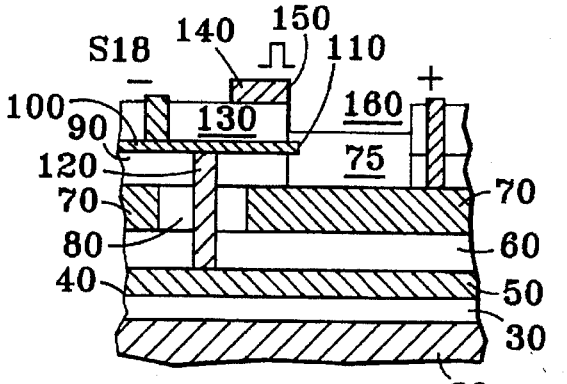

FIGS. 4*a* and 4*b* together show a flow diagram of an embodiment of a fabrication process performed in accordance with the invention. FIGS. 5a–5r show a series of side elevation cross sectional views corresponding to results of the process steps of FIGS. 4a and 4b. The individual structural elements of FIGS. 5a–5r are easily identified by reference to the corresponding elements of FIGS. 1, 2, and 3. In the following description of a preferred process for fabricating field-emission devices, reference is made to FIGS. 4a, 4b, 5a–5r, in which the same or similar process steps and the device side elevation cross-sectional views of results corresponding to those steps are both denoted by the same step references S1, S2, . . . , S18. A simple overall process outline for fabrication of a diode device is described first, followed by a description of the detailed process which is depicted in FIGS. 4a and 4b and which is further illustrated by the corresponding results of FIGS. 5a–5r.

In a simple fabrication process for a lateral-emitter direct electron injection field-emission display diode device, the following steps are performed: an anode film 70 is deposited (S7); an insulator film 90 is deposited (S8) over the anode film; an ultra-thin conductive emitter film 100 is deposited (S12) over the insulator and patterned; a trench opening 160 is etched (S15) through the emitter and insulator, stopping at the anode film 70, thus forming and automatically aligning an emitting edge 110 of the emitter; a phosphor 75 is deposited (S16) in opening 160 to a level such that emitting edge 110 is covered by phosphor; and means are provided (S18) for applying an electrical bias to the emitter and anode, sufficient to cause field emission of electrons from the emitting edge 110 of the emitter 100 to the anode 70. The phosphor may comprise any cathodoluminescent material having high enough resistivity, and the phosphor should be selected on the basis of both its conductivity and the color of its luminescence. With respect to conductivity, the phosphor should have a a conduction band substantially empty of electrons at the device's use temperature (e.g. room temperature or 20° C.). Suitable phosphor materials also have electric permittivity such that the electric field at emitter edge or tip 110 is high enough to cause cold cathode field emission of electrons into the phosphor 75 when an electrical bias of suitable polarity and voltage is applied, in accordance with the Fowler-Nordheim equation governing field emission [R. H. Fowler and L. W. Nordheim, Proceedings of the Royal Society London A, Vol. 119 (1928), pages 173 ff.]. Other factors, such as efficiency, may also be important in choosing a phosphor material for particular applications.

A fabrication process for a triode, tetrode, etc. device may also include steps to deposit additional insulator films 130 and to deposit additional conductive films 140 for control electrodes, which have a control electrode edge 150 automatically aligned with the emitter blade edge or tip 110. In the following detailed process description, these additional steps are included as "optional" steps, to be performed only if control electrodes are to be included in a particular device structure. It will be apparent to one skilled in the art that the detailed process of FIGS. 4a and 4b, illustrated by the results of FIGS. 5a–5r, may be modified to fabricate simpler devices by omitting particular process steps as appropriate. Other variations in technique and in the order of process steps will also be apparent to one skilled in the art.

A detailed description of a preferred process for fabricating the field-emission devices now proceeds, with reference to FIGS. 4a, 4b, 5a–5r.

To fabricate a triode device with one or two control electrodes, the process illustrated in FIGS. 4a, 4b, 5a–5r is performed. A substrate 20 is provided (step S1), which may be a silicon wafer. An insulating layer 30 is deposited (step S2) on the substrate. This may be done, for example, by growing a film of silicon oxide approximately one micrometer thick on a silicon substrate. A pattern is defined on the insulator surface for depositing a conductive material. In the preferred process, a pattern of recesses is defined and etched (step S3) into the surface of the insulator layer. In step S4, metal is deposited in the recesses to form a buried contact layer 50, which is then planarized (step S5). While this is described here as a metal deposition, the conductive material deposited in step S4 may be a metal such as aluminum, tungsten, titanium, etc., or may be a transparent conductor such as tin oxide, indium tin oxide (ITO), etc. (For applications using a common emitter for all devices made on a substrate, the substrate may be conductive and perform the function of a buried emitter contact. For such applications, steps S2, S3, S4, and S5 may be omitted, although a step similar to step S2 may be required to insulate a control electrode if any from the substrate.) Similarly, in another variation, a conductive substrate may serve as a common buried anode contact instead of as a common buried emitter contact.

An insulating layer 60 is deposited in step S6. This may be a chemical vapor deposition of silicon oxide to a thickness of about 0.1 to 2 micrometers, for example. A conductive layer is deposited (step S7) to a predetermined thickness and patterned to form an anode layer 70. Conductive anode layer 70 deposited in step S7 may be a metal film or another conductive film such as indium oxide or indium tin oxide (ITO). If the application requires anode layer 70 to be patterned, that patterning may be done by subprocesses that are conventional in semiconductor fabrication practice, using lithography and etching to pattern the layer. In particular, anode layer 70 may be formed and patterned by a process analogous to steps S3, S4, and S5.

In the next step (S8), an insulating layer 90 is deposited to a precisely predetermined thickness. This predetermined thickness of insulating layer 90 is quite important in determining the emitter-to-anode closest distance, and thus in determining the electric field produced by a given applied bias voltage. Step S8 may comprise chemical vapor deposition of silicon oxide to a predetermined thickness in the range of 0.1 to 2 micrometers, for example.

Steps S9 and S10 are performed if a control electrode layer 140 is needed below the emitter layer 100. (Such a control electrode layer is shown in FIGS. 5i–5j, but then omitted from FIGS. 5k–5r to illustrate the option without a lower control electrode layer.) If needed, a conductive control electrode layer 140 is deposited and patterned in step S9. Step S9 is preferably performed in the same manner as the combination of steps S3, S4, and S5, i.e. by patterning recesses, filling them, and planarizing. In step S10 an insulating layer 130 of a predetermined thickness is deposited over conductive control electrode layer 140 to insulate it and to provide a flat insulating surface parallel to the substrate for the next step. Whether or not steps S9 and S10 are performed, a planar insulating surface is provided.

This description of a fabrication process continues with reference to FIG. 4b and FIGS. 5k–5r, respectively showing the remaining fabrication steps and the corresponding side cross sectional views of the device. In step S11, conductive contacts 120 are provided to the buried contact layer 50, by opening suitable contact holes and depositing conductive material in them (forming "studs") to make ohmic contact with buried contact layer 50. In step S12, an ultra-thin emitter layer 100 is deposited and patterned. Preferred materials for conductive lateral-emitter layer 100 are titanium, tungsten, tantalum, molybdenum, or their alloys, such as titanium-tungsten alloy. However, many other conductors may be used, such as aluminum, gold, silver, copper, copper-doped aluminum, platinum, palladium, polycrystalline silicon, etc. or transparent thin-film conductors such as tin oxide or indium tin oxide (ITO). It is very desirable to use a material with a low work function for electron emission. In this respect, emitter materials preferably have work functions of less than five electron volts, and even more preferably have work functions of less than one electron volt.

The deposition in step S12 is controlled to form a film preferably of about 100–300 ångstroms thickness or less in order to have an emitter blade edge or tip 110 in the final structure that has a radius of curvature preferably less than 150 ångstroms and more preferably less than 50 ångstroms. To fabricate the preferred embodiment of FIG. 1, patterning of lateral emitter 100 is done so that lateral emitter 100 is aligned with respect to anode 70. (If lateral emitter 100 extends over a portion of anode 70 at this point in the process, that portion of lateral emitter 100 will be removed later in the process.) An insulator 130 is deposited (step S13) over the emitter layer. Again this may be a chemical vapor deposition of silicon oxide to a thickness of about 0.1 to 2 micrometers, for example. If there are to be two control electrodes and if symmetry with respect to the plane of emitter layer 100 is desired, then this insulator layer 130 should be made the same thickness as the insulator layer 130 deposited in step S10. Both insulator layers designated by the same reference numeral 130 (at steps S10 and S13) insulate control electrodes. If a control electrode 140 is to be incorporated, a conductive material is deposited and patterned (step S14) to form the upper control electrode layer 140. (The control electrode 140 may be deposited in a recess pattern and planarized, as in the case of the buried contact layer 50.) It should be mentioned that the conductive films deposited and patterned in steps S4, S9 (if performed), S12, and S14 (if performed) are all deposited in at least partial alignment with respect to the anode film 70 that was deposited and patterned in step S7.

In step S15, an opening 160 is provided through all the layers lying over anode 70, down to the top surface of anode layer 70. This opening 160 is patterned to intersect at least some portions of emitter layer 100 (and of control electrode layers 140 if any), and to define emitting edge 110 of emitter layer 100 (and to define edge 150 of control electrode layer 140 if any). This step is performed by using conventional directional etching processes such as reactive ion etching sometimes called "trench etching" in the semiconductor fabrication literature.

In step S16, phosphor material 75 is deposited in opening 160 on anode 70, and to a thickness such that emitter edge or tip 110 is covered by the phosphor. Any excess phosphor not in opening 160 is removed. Suitable phosphors include gallium nitride (GAN), gallium phosphide (GAP), curopium-activated tin oxide ($SnO_2$:Eu), manganese activated zinc gallium oxide ($ZnGa_2O_4$:Mn), terbium-activated lanthanum oxysulfide, ($La_2O_2S$:Tb), curopium-activated yttrium oxysulfide ($Y_2O_2S$:Eu), terbium-activated lanthanum oxybromide (LaOBr:Tb), and zinc cadmium sulfide activated with silver and indium oxide ((ZnCd)S:Ag+ $In_2O_3$). Many other cathodoluminescent compounds having the requisite high bulk resistivity are suitable if prepared with sufficient purity and with careful control of the type and concentrations of impurities and/or activators. The need for a low electric permittivity of the phosphor material was discussed hereinabove. Still other suitable phosphor materials may be adapted from some of those described, for example, in the chapter by Takashi Hase et al. "Phosphor Materials for Cathode Ray Tubes" in "Advances in Electronics and Electron Physics" Vol. 79 (Academic Press, San Diego, Calif., 1990), pages 271–373, the disclosure of which is hereby incorporated by reference.

Although direct contact or immersion of the emitter edge or tip 110 in phosphor 75 (zero gap width) is preferred, it is possible to make an operable device with very small gap, even as small as about 100 times the thickness of emitter 100 or less. For example, if emitter 100 is made 10 ångstroms thick, the gap width may be 1,000 ångstroms or less. This may be done, for example by depositing a phosphor 75 having a suitable thermal expansion, using an elevated deposition temperature in step S16. Upon cooling to the temperature of the use environment, this phosphor 75 contracts sufficiently to make a very small gap between emitter edge or tip 110 and phosphor 75. It will be recognized that the lateral width of opening 160 must be taken into account in calculating the thermal expansion and contraction.

In step S17 contact holes are opened to emitter, control electrode, and anode if needed. Metal contacts are deposited where needed. Alternatively, this part of the process (step S17) may be performed after step S13 or S14 but before S15. In that case, the sequence of process steps would be as follows: S13, S14 (if used), S17, and then S15 and S16,. It should be noted that for some display applications (such as so-called "heads-up" displays), it is desirable to form the device structure using substantially transparent materials for all the films. With the operable and preferred thicknesses of the films in the present invention, such transparent films may be made if desired.

In step S18, means are provided for applying suitable electrical bias voltages, and (for devices incorporating control electrodes) suitable signal voltages. Such means may include, for example, contact pads selectively provided at the device top surface to make electrical contact, and optionally may include wire bonds, means for tape automated bonding, flip-chip or C4 bonding, etc. In use of the device, of course, conventional power supplies and signal sources must be provided to supply the appropriate bias voltages and control signals. These will include providing sufficient voltage amplitude of the correct polarity (anode positive) to cause cold-cathode field emission of electron current from emitter edge 110 to anode 70. If desired, a passivation layer may be applied to the device top surface, except where there are conductive contact studs and/or contact pads needed to make electrical contacts. This completes the description of the detailed process illustrated in FIGS. *4a*, *4b*, *5a–5r*.

While this process has been described for a particular preferred structure, it will be recognized that it is not necessary that the order of the layers in the device structure be preserved. For example, the substrate may the top layer, and the layers may be disposed in the opposite order to that described herein. Also, a single control electrode layer may be either above or below the lateral emitter layer.

Although a notable advantage of the present invention is that it does not require a vacuum or inert gas atmosphere, there may be applications in which such an environment is desirable. If it is desired to have the field-emission cell operating with a vacuum or a low pressure inert gas in opening 160, it is necessary to enclose that space or cavity. This can be done by a process similar to that described in the anonymous publication "Ionizable Gas Device Compatible with Integrated Circuit Device Size and Processing," publication 30510 in "Research Disclosure", Number 305 (September 1989), the disclosure of which is hereby incorporated by reference. Such a process can be begun by etching a small auxiliary opening, connected to the opening provided in step S15. This auxiliary opening may be made at a portion of the cavity spaced away from the emitter edge area. The opening for the main cavity and the connected auxiliary opening are both filled temporarily with a sacrificial organic material, such as parylene, and then planarized. An inorganic insulator is deposited, extending over the entire device surface including over the sacrificial material, to enclose the cavity. A hole is made in the inorganic insulator by reactive ion etching or by wet etching only over the auxiliary opening. The sacrificial organic material is removed from within the cavity by a plasma etch, such as an oxygen plasma etch, which operates through the hole. The atmosphere surrounding the device is then removed to evacuate the cavity. If an inert gas filler is desired, then that gas is introduced at the desired pressure. Then the hole and auxiliary opening are immediately filled by sputter-depositing an inorganic material to plug the hole. If introduction of a gettering material is desired, the hole-plugging step may consist of two or more substeps: viz. depositing a quantity of getter material, and then depositing an inorganic insulator to complete the plug. The plug of inorganic insulator seals the cavity and retains either the vacuum or any inert gas introduced. The gettering material, if used, is chosen to getter any undesired gases, such as oxygen or gases containing sulfur, for example. Some suitable getter materials are Ca, Ba, Ti, alloys of Th, or other conventional getter materials known in the art of vacuum tube construction. This process for retaining vacuum or gas atmospheres is not illustrated in FIGS. 4*a*, 4*b*, 5*a*–5*r*.

It will be appreciated by those skilled in the art that integrated arrays of field-emission devices, such as the array of FIG. 3, may be made by simultaneously performing each step of the fabrication process described herein for a multiplicity of field-emission devices on the same substrate, while providing various interconnections among them. An integrated array of field-emission devices made in accordance with the present invention has each device made as described herein, and the devices are arranged as cells containing at least one emitter and at least one anode per cell. The cells are arranged along rows and columns, with the anodes interconnected along the columns for example, and the emitters interconnected along the rows.

There are many diverse uses for the field-emission device structure and fabrication process of this invention, especially in making flat panel displays for displaying images and for displaying character or graphic information with high resolution. It is expected that the type of flat panel display made with the device of this invention can replace many existing displays including liquid-crystal displays, because of their lower manufacturing complexity and cost, lower power consumption, higher brightness, and improved range of viewing angles. Displays made in accordance with the present invention are also expected to be used in new applications such as displays for virtual reality systems. In embodiments using substantially transparent substrates and films, displays incorporating the structures of the present invention are especially useful for augmented-reality displays.

Other embodiments of the invention will be apparent to those skilled in the art from a consideration of this specification or from practice of the invention disclosed herein. For example, the order of process steps may be varied to some extent for various purposes; improved lithographic patterning, deposition, etching, or other process techniques may be used; functionally equivalent materials may be substituted for the particular materials used in the embodiments described herein; preferred dimensions may be varied; the order of some layers in the device structure may be varied, and other modifications may be made to adapt the device to various usages and conditions. While reference is made herein to the theory of field emission of electrons, the invention should not be construed as being limited to the consequences of such a theory. It is intended that the specification and examples be considered as exemplary only, with the true scope and spirit of the invention being defined by the following claims.

Having described my invention, I claim:

1. A microelectronic device display cell structure, comprising:

(a) a substrate;

(b) an anode;

(c) a phosphor disposed on said anode, said phosphor having first and second phosphor surfaces, and said first phosphor surface being substantially orthogonal to said substrate;

(d) a conductive thin-film electron emitter substantially parallel to said substrate, said emitter having an emitting edge spaced apart from said anode, said emitting edge being disposed in contact with said first phosphor surface, and said emitter edge extending into said phosphor; and (e) means for applying an electrical bias voltage to said anode and to said electron emitter sufficient to excite cathodoluminescence in said phosphor, in order to cause light emission from said phosphor.

2. A microelectronic device display cell structure as recited in claim 1, wherein said anode is substantially parallel to said substrate.

3. A microelectronic device display cell structure as recited in claim 1, wherein said phosphor is electrically non-conductive.

4. A microelectronic device display cell structure as recited in claim 1, wherein said phosphor is characterized by having a conduction band substantially empty of electrons at temperatures of less than or equal to 20° C.

5. A microelectronic device display cell structure as recited in claim 1, wherein said phosphor is characterized by an electric permittivity such that, when said electrical bias voltage is applied, the electric field at said emitting edge is sufficient to cause electron emission in accordance with the Fowler-Nordheim equation.

6. A microelectronic device display cell structure as recited in claim 1, wherein said second phosphor surface is substantially parallel to said substrate, allowing said light emission to occur through said second phosphor surface.

7. A microelectronic device display cell structure as recited in claim 1, wherein said anode extends at least partially under said emitting edge.

8. A microelectronic device display cell structure as recited in claim 1, wherein said electron emitter comprises a thin-film structure having a thickness less than 300 ångstroms.

9. A device as recited in claim 8, wherein said thin-film structure comprises at least one film having a work function for electron emission below about five electron volts.

10. A device as recited in claim 8, wherein said thin-film structure comprises at least one metallic film.

11. A microelectronic device display cell structure as recited in claim 1, wherein said emitting edge of said electron emitter comprises a blade having a radius of curvature less than 150 ångstroms.

12. A microelectronic device display cell structure as recited in claim 1, wherein said phosphor comprises a material selected from the list consisting of:

GaN, GaP, $SnO_2$:Eu, $ZnGa_2O_4$:Mn, $La_2O_2S$:Tb, $Y_2O_2S$:Eu, LaOBr:Tb, and (ZnCd)S:Ag+$In_2O_3$.

13. A microelectronic device display cell structure as recited in claim 1, wherein said phosphor comprises a plurality of phosphor materials characterized by having different colors of cathodoluminescence.

14. A microelectronic device display cell structure as recited in claim 1, wherein said phosphor comprises three phosphor materials characterized by having cathodoluminescence in the red, green, and blue portions of the spectrum respectively.

15. A microelectronic device display cell structure as recited in claim 1, wherein all elements of said device are substantially transparent to light.

16. A microelectronic device display cell structure as recited in claim 6, further comprising:

(f) a conductive control electrode disposed on a plane spaced from said anode and said electron emitter, said control electrode having a control electrode edge substantially aligned with said emitting edge of said electron emitter;

(g) an insulating layer disposed between said control electrode and said electron emitter; and (h) means for applying a control signal to said conductive control electrode, whereby said device may be controlled.

* * * * *